United States Patent [19]

Kimura

[11] Patent Number: 4,958,677

[45] **Date of Patent: * Sep. 25, 1990**

[54] ROLLING INSTALLATION FOR AND ROLLING METHOD OF CONTINUOUS CAST STRIP

[75] Inventor: Tomoaki Kimura, Hitachi, Japan

[73] Assignee: Hitachi, Ltd., Tokyo, Japan

[ * ] Notice: The portion of the term of this patent subsequent to Jul. 11, 2006 has been disclaimed.

[21] Appl. No.: 376,648

[22] Filed: Jul. 7, 1989

Related U.S. Application Data

[63] Continuation of Ser. No. 203,108, Jun. 7, 1988, Pat. No. 4,846,254.

[30] Foreign Application Priority Data

Jun. 11, 1987 [JP] Japan ..... 62-146042

[51] Int. Cl.[5] ..... B21B 1/46

[52] U.S. Cl. ..... 164/452; 164/154; 164/476; 164/417; 29/527.7

[58] Field of Search ..... 164/417, 476, 477, 76.1, 164/270.1, 154, 452; 29/527.5, 527.7

[56] References Cited

U.S. PATENT DOCUMENTS

| | | | |
|---|---|---|---|
| 3,358,358 | 12/1967 | Jenks et al. | 164/476 |
| 3,565,160 | 2/1971 | Hermann et al. | 164/417 |
| 3,580,032 | 5/1971 | Stone | 164/476 |
| 3,680,623 | 8/1972 | Tarmann et al. | 164/476 |
| 4,532,789 | 8/1935 | Bruinsma et al. | 72/202 |

FOREIGN PATENT DOCUMENTS

| | | |
|---|---|---|
| 905005 | 1/1954 | Fed. Rep. of Germany . |
| 55-133803 | 10/1980 | Japan . |
| 60-87903 | 5/1985 | Japan . |
| 60-221103 | 11/1985 | Japan . |
| 61-279307 | 12/1986 | Japan . |
| 62-6745 | 1/1987 | Japan . |
| 62-101301 | 5/1987 | Japan . |

*Primary Examiner*—Richard K. Seidel

*Attorney, Agent, or Firm*—Fay, Sharpe, Beall, Fagan, Minnich & McKee

[57] ABSTRACT

A rolling installation comprises a continuous casting machine, and a light thickness-reduction rolling mill, a width-reduction rolling mill and a thickness-reduction rolling mill which are arranged downstream of the continuous casting machine. The light thickness-reduction rolling mill is driven with a power lower than that required for thickness-reduction rolling by the light thickness-reduction rolling mill. The power deficiency is supplied to the light thickness-reduction rolling mill by the thickness-reduction rolling mill through the cast strip. As a result, a longitudinal tension is applied to the cast strip passing through the width-reduction rolling mill, thereby preventing the cast strip from being buckled and deformed at the width-reduction rolling.

12 Claims, 3 Drawing Sheets

ROLLING INSTALLATION FOR AND ROLLING METHOD OF CONTINUOUS CAST STRIP

This application is a continuation of Ser. No. 203,108, filed June 7, 1988, now U.S. Pat. No. 4,846,254.

BACKGROUND OF THE INVENTION

The present invention relates to an installation for and a method of rolling a continuous cast strip and, more particularly, to a rolling installation and a rolling method suitable for rolling a thin slab cast strip cast by a continuous casting machine, to reduce a width of the strip without cutting the same.

Conventionally, a system is known in which a sheet-like thin slab cast strip cast by a continuous casting machine is hot-rolled, without cutting the cast strip, to produce a hot-rolled strip, from the viewpoint of energy saving and improvement of the yield. However, such system have numerous problems in regulating a width-reduction rolling of the strip. That is, if the thin slab cast strip is rolled to be reduced in width while the cast strip is hot, buckling and deformation occur in the the cast strip widthwise thereof. Thus, in practice, it is almost impossible to regulate the strip width.

Japanese Patent Application Laid-Open Nos. 60-87903 and 55-133803 disclose width-reduction rolling techniques for such thin slabs.

In the technique disclosed in Japanese Patent Application Laid-Open No. 60-87903, a continuous casting machine of double-drum type is employed, and a vertical width-reduction rolling mill is arranged upstream of a thickness-reduction rolling mill. The arrangement is such that a thin slab cast strip cast by the continuous casting machine of a double-drum type is rolled to be reduced in strip width by the vertical rolling mill, thereby regulating the strip width.

In the technique proposed in Japanese Patent Application Laid-Open No. 55-133803, a width-reduction rolling mill is arranged between a pair of thickness-reduction rolling mills. At width-reduction rolling, respective portions of a thin slab cast strip in front of and in rear of the width-reduction rolling mill are restrained respectively by the thickness-reduction rolling mills, to thereby prevent the cast strip from being buckled and deformed widthwise of the cast strip.

The thin slab cast strip delivered from the continuous casting machine is relatively wide. For example, the strip thickness is 20 to 40 mm, while the strip width is 600 to 1600 mm. By this reason, when the cast strip is compressed widthwise thereof by the vertical rolls in accordance with the proposal described in Japanese Patent Application Laid-Open No. 60-87903, buckling at once occurs in the cast strip. Thus, it has been found that the method disclosed in this Japanese patent does not effectively regulate of the strip width.

On the other hand, in the proposal described in Japanese Patent Application Laid-Open No. 55-133803, the respective portions of the thin slab cast strip in front of and in rear of the width-reduction rolling mill are restrained respectively by the thickness-reduction rolling mills. It has been likewise impossible, however, to obtain sufficient effects of regulation of the strip width with this method. That is, the rolls of the actual width-reduction rolling mill are equal to or larger than 600 mm in diameter, and the rolls of each of the thickness-reduction rolling mills are also equal to or larger than 600 mm. Accordingly, even if the number of the rolls in the width-reduction rolling mill is not three pairs as is in the above Japanese patent, but is reduced to a single pair, a distance between the respective thickness-reduction roll pairs in front of and in rear of the width-reduction rolling mill is to a large value, such as $600 \times 2 = 1200$ mm. As a result, it becomes impossible to sufficiently restrain the cast strip widthwise thereof by the thickness-reduction roll pairs. Thus, there is little effect on prevention of widthwise deformation at the width-reduction rolling.

SUMMARY OF THE INVENTION

It is an object of the invention to provide a rolling method capable of effectively preventing a continuous cast strip from buckling and being and deformed widthwise thereof during rolling of the strip to reduce its width without cutting the strip.

It is another object of the invention to provide a rolling installation which does not require high rolling load per unit width rolling reduction when a continuous cast strip is rolled by a width-reduction rolling mill without cutting the strip, whereby it is made possible to roll the strip to reduce its width at a high reduction ratio.

For the purposes described above, according to the invention, there is provided a rolling method comprising the step of rolling a cast strip to reduce its width while applying a longitudinal tension to the cast strip as it passes through a width-reduction rolling mill.

Further, according to another aspect of the invention, there is provided a rolling installation of the kind referred to above, wherein a loop regulating looper, a light thickness-reduction rolling mill, a width-reduction rolling mill and a thickness-reduction rolling mill are arranged downstream of a continuous casting machine in the mentioned order, and wherein means is provided in association with the width-reduction rolling mill for applying a longitudinal tension to a cast strip passing through the width-reduction rolling mill.

Application of the longitudinal tension to the cast strip makes it easy for compression strain to occur in the cast strip widthwise thereof by width-reduction rolls of the width-reduction rolling mill. This reduces the width-reduction rolling load per unit width rolling reduction. Thus, it is made difficult for buckling to occur widthwise of the cast strip.

Further, since the loop regulating looper, the light thickness-reduction rolling mill, the width-reduction rolling mill and the thickness-reduction rolling mill are arranged in the mentioned order, it is possible to apply the tension with the light thickness-reduction rolling mill and the thickness-reduction rolling mill. That is, power driving the light thickness-reduction rolling mill, which is arranged upstream of the width-reduction rolling mill is restrained to a level lower than that normally required for light thickness-reduction rolling, and the power needed to compensate for the deficiency is supplied to the light thickness-reduction rolling mill by the thickness-reduction rolling mill arranged downstream of the width-reduction rolling mill through the cast strip ,thereby applying a tension to the cast strip during width-reduction rolling.

During the width-reduction rolling, the speed of the cast strip is in general brought into nonconformity with that at which the cast strip is fed out of the continuous casting machine, by the thickness-reduction action due to the light-reduction rolling mill arranged upstream of the width-reduction rolling mill. The influence due to the nonconformity in speed is brought out as a change in a loop amount at the loop regulating looper arranged between the continuous casting machine and the light-reduction rolling mill. Thus, preferably, control is made in such a manner that the change in the loop amount is detected, and the rotational speed of the rolls in the thickness-reduction rolling mill arranged downstream of the width-reduction rolling mill is so regulated as to bring the loop amount to a constant value. This makes it possible to maintain the speed of the cast strip in the continuous casting machine, at a desired value.

The light thickness-reduction rolling mill serves also to correct a thickness error of the strip widthwise thereof, which is caused at the continuous casting machine.

DETAILED DESCRIPTION OF PREFERRED EMBODIMENTS

The invention will be described below with reference to the embodiments illustrated in FIGS. 1 through 4. Although each of the illustrated embodiments employs a continuous casting machine of the double-belt type, the same functional advantages are achieved if a continuous casting machine of another type such as inclined double-belt type, or double-drum type disclosed in Japanese Patent Application Laid-Open No. 60-87903 is employed in substitution for the continuous casting machine of double-belt type.

Figure 1:
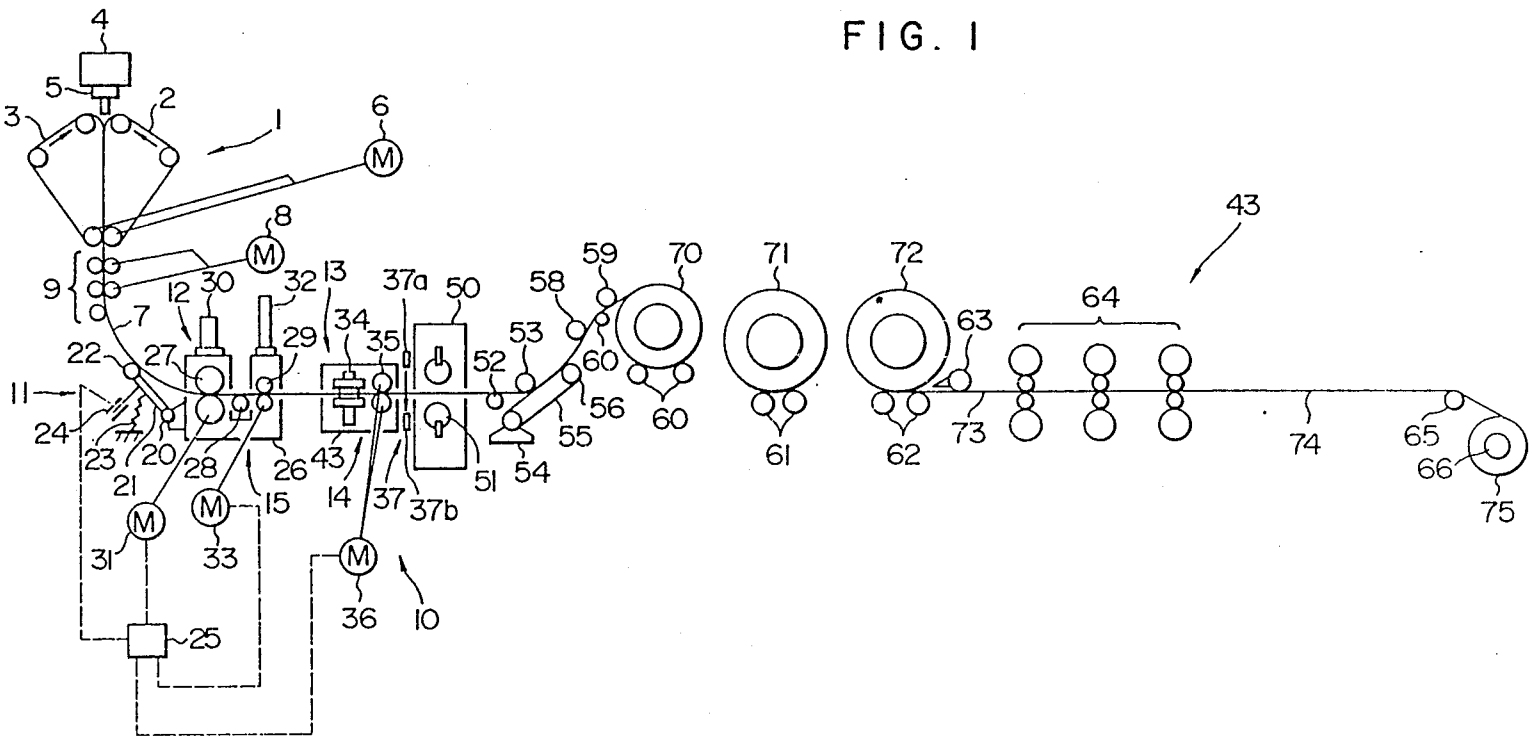
FIG. 1 is a schematic view showing a rolling installation according to an embodiment of the invention, and a continuous casting machine and a thickness-reduction rolling installation arranged respectively in front of and in rear of the rolling installation according to the embodiment.
Figure 2:
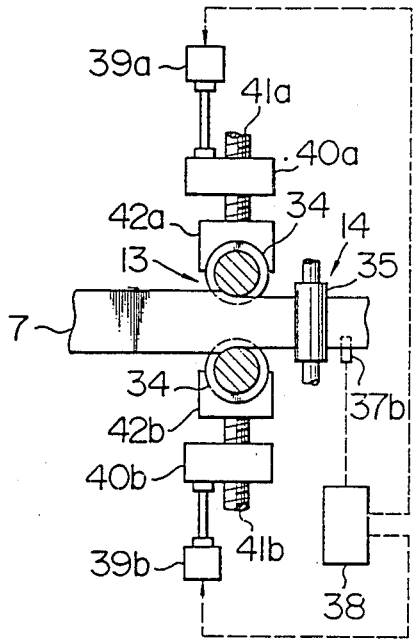
FIG. 2 is a top plan view showing a width reduction control mechanism associated with width-reduction rolls in the rolling installation illustrated in FIG. 1.
Figure 3:
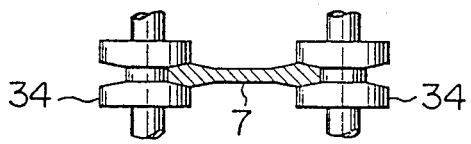
FIG. 3 is a front elevational view showing a cast strip being rolled to be reduced in width by the width-reduction rolls illustrated in FIG. 2.

Referring to FIGS. 1 through 3, a continuous casting machine 1 of double-belt type comprises, as usual, a pair of belts 2 and 3 each of which is guided by three guide rollers. The pair of belts 2 and 3 cooperate with each other to define a mold into which molten metal from a tundish 4 is poured through a nozzle 5. The belts 2 and 3 are adapted to be run in their respective directions indicated by arrows in FIG. 1, by the respective lower belt guide rollers which are rotatively driven by a motor 6. Thus, a thin slab cast strip 7 is continuously cast through an outlet of the mold defined between the belts 2 and 3. As described previously, the cast strip 7 is of the order of 20 to 40 mm in thickness and 600 to 1600 mm in width. The casting speed is in the order of 10 to 15 m/min.

The cast strip 7 obtained from the continuous casting machine 1 is bent by a group of rollers 9 of a bending device which are arranged downstream and adjacent the continuous casting machine 1 and which are driven by a motor 8. Subsequently, the cast strip 7 is changed in its course to the horizontal direction. The cast strip 7 is then hot-rolled without being cut, by a rolling installation 10 arranged downstream of the bending device.

Generally speaking, the rolling installation 10 comprises a loop regulating looper 11, a light thickness-reduction rolling mill 12, a width-reduction rolling mill 13 and a thickness-reduction rolling mill 14 arranged in the mentioned order. In the illustrated embodiment, the light thickness-reduction rolling mill 12 is incorporated in a cast strip correcting machine 15 for again bending the cast strip 7 bent by the group of bending rollers 9, into the straight form.

The loop regulating looper 11 is of the type in which a roller 22 mounted on an arm 21 is pivotally movable about a pivot 20 that is urged against the cast strip 7 under the biasing force of a spring 23. Displacement of the arm 21 is detected by a differential transformer 24. A signal indicative of the detected displacement is sent to a controller 25 so as to control a loop amount at the loop regulating looper 11 to a constant value in a manner subsequently to be described.

The light thickness-reduction rolling mill 12 and the cast strip correcting machine 15 have a stand 26 common to them. Arranged within the stand 26 are a pair of light thickness-reduction rolls 27 serving also as correcting rolls, an intermediate roll 28 and a pair of correcting rolls 29. An upper one of the light thickness-reduction rolls 27 is capable of being adjusted in vertical position by a cylinder 30. The light thickness-reduction rolls 27 are adapted to be driven by a motor 31. On the other hand, an upper one of the correcting rolls 29 is vertically movable by a cylinder 32, and the correcting rolls 29 are adapted to be driven by a motor 33.

The width-reduction rolling mill 13 is composed of a pair of vertical width-reduction rolls 34 arranged within a stand 43.

The thickness-reduction rolling mill 14 is composed of a pair of thickness-reduction rolls 35 which are also arranged within the stand 43. These thickness-reduction rolls 35 are adapted to be driven by a motor 36.

The motors 31, 33 and 36 are controlled by a controller 25.

The controller 25 sets the power supplied to the motor 31 driving the light thickness-reduction rolls 27 of the light thickness-reduction rolling mill 12, to a low value and, if necessary, to a zero or a negative value. On the other hand, the power supplied of the motor 36 driving the thickness-reduction rolls 35 of the thickness-reduction rolling mill 14 is set to a high value. The power needed to compensate for the deficiency for the light thickness-reduction rolls 27 is supplied by the thickness-reduction rolls 35 through the cast strip 7. By doing so, a tension is applied to a portion of the cast strip 7 extending between the light thickness-reduction rolls 27 and the thickness-reduction rolls 35. That is, the light thickness-reduction rolling mill 12 and the thickness-reduction rolling mill 14 cooperate with each other to form tension applying means for applying a longitudinal tension to the cast strip 7 passing through the width-reduction rolling mill 13.

Controller 25 also receives as an input the detected value from the differential transformer 24 for detecting the loop amount at the loop regulating looper 11. On the basis of the magnitude of the detected value from the differential transformer 24, the controller 25 controls the motor 36 driving the thickness-reduction rolls 35 in such a manner that the loop amount is brought to a constant value, thereby regulating the rolling speed.

Arranged on the exit side of the thickness-reduction rolls 35 is a strip width detector 37 for detecting the width of the cast strip 7. On the basis of a detected value from the strip width detector 37, a width reduction at the width-reduction rolling mill 13 is regulated automatically, so that the width of the cast strip 7 is brought to a constant value on the exit side of the thickness-reduction rolls 35.

The strip width detector 37 may be of an optical type which includes in a combination of a light emitter 37*a* and a light receiver 37*b*.

As shown in FIG. 2, a control mechanism for controlling the width reduction at the width-reduction rolling mill 13 has a controller 38 having inputted thereto the detected value from the light receiver 37*b* of the strip width detector 37, and a pair of motors 39*a* and 39*b* controlled by the controller 38. The control mechanism further comprises a pair of worm speed-reducing units 40*a* and 40*b* driven respectively by the motors 39*a* and 29*b*, a pair of screws 41*a* and 41*b* threadedly engaged with the respective speed-reducing units 40*a* and 40*b*, and a pair of bearing boxes 42*a* and 42*b* for width-reduction rolls 34 respectively and 34. The bearing boxes 42*a* and 42*b* are connected respectively to the screws 41*a* and 41*b*.

The cast strip 7 having passed through the thickness-reduction rolling mill 14 is once taken up to form a coil. Subsequently, the cast strip 7 is rewound from the coil and is rolled to a predetermined thickness by a thickness-reduction rolling installation 43 which is provided as a subsequent step.

To this end, the rolling installation 10 has a pair of rotary cutters 51 arranged within a stand 50 located downstream of the thickness-reduction rolling mill 14, and an upward bending unit located downstream of the stand 50. The upward bending unit is composed of two rollers 52 and 53, and a roller 56 which is mounted to an arm 55 supported on a bracket 54. The rolling installation 10 further comprises a downward bending unit composed of three rollers 57, 58 and 59, and a pair of coil support rollers 60.

The thickness-reduction rolling installation 43 is arranged with a pair of intermediate stand-by position rollers 61 located between the rolling installations 10 and 43. Arranged in the thickness-reduction rolling installation 43 are unwinding rollers 62, an end-finding knife roller 63, a thickness-reduction rolling mill 64 having a group of thickness-reduction rolls, a guide roller 65, and a take-up drum 66.

The operation of the embodiment constructed as above will be described below.

The cast strip 7 cast by the continuous casting machine 1 and bent by the group of bending rollers 9 passes by the loop regulating looper 11, and is delivered to the light thickness-reduction rolling mill 12 and the cast strip correcting machine 15 where the cast strip 7 is bent. Subsequently, the cast strip 7 is again bent, to the horizontal direction, by the pair of light thickness-reduction rolls 27, the intermediate roller 28 and the pair of correcting rolls 29.

At this time, the light thickness-reduction rolls 27 perform their function of correcting bending of the cast strip 7 and, in addition thereto, perform also the following function.

That is, the thickness of the cast strip 7 obtained from the continuous casting machine 1 has an error in the strip widthwise direction. This error is of the order of ±1.0 mm. If the cast strip 7 having such widthwise thickness error is to be rolled by the subsequent thickness-reduction rolls 35, then the temperature of the cast strip 7 will drop by approximately 100 degrees C. for a period of time until the cast strip 7 reaches the thickness-reduction rolls 35. At such a low temperature, the rolling deformation resistance of the cast strip 7 will be high so that plastic flow in the strip widthwise direction is difficult to occur. Accordingly, a plastic flow error in the longitudinal direction of the cast strip 7 will occur due to the strip widthwise thickness error. This results in products in which the cast strip surface is irregular in configuration.

On the other hand, at the re-bending initiating point of the cast strip 7 where the cast strip correcting machine 15 is arranged, the temperature of the cast strip 7 is high such as 1150 to 1200 degrees C. Under such high temperature condition, the deformation resistance of the cast strip 7 is low such as 3 to 5 kg/cm$^2$. Accordingly, if light-reduction rolling of the order of 1 to 3 mm in rolling reduction is carried out, the thickness error in the widthwise direction of the cast strip is corrected for by plastic flow deformation in the widthwise direction. Thus, the strip thickness in the widthwise direction is corrected so as to be brought to a uniform value.

The plastic flow in the widthwise direction due to the light thickness-reduction rolls 27 is caused to occur more effectively in the illustrated embodiment in which the tension is applied to the portion of the cast strip extending between the light thickness-reduction rolls 27 and the thickness-reduction rolls 35 so that a tension is also applied to a portion of the cast strip at the light thickness-reduction rolls 27.

After the cast strip 7 is corrected to the horizontal direction, width-reduction rolling is effected by the width-reduction rolls 34 of the width-reduction rolling mill 13, and thickness-reduction rolling is performed by the thickness-reduction rolls 35 of the thickness-reduction rolling mill 14.

At this time, as described previously, the light thickness-reduction rolls 27 and the thickness-reduction rolls 35 serve as tension generating means, because of the difference in driving power between the rolls 27 and the rolls 35, so that the tension is applied to the portion of the cast strip 7 extending between these thickness-reduction rolls 27 and 35. Accordingly, the longitudinal tension is applied to the cast strip 7 passing through the nip between the width-reduction rolls 34. This makes it easy for compression strain to occur in the cast strip 7 in the widthwise direction during width-reduction rolling due to the width-reduction rolls 34, resulting in a decrease in the width-reduction rolling load per unit width rolling reduction. Thus, it is difficult for buckling to occur in the widthwise direction of the cast strip 7, making it possible to increase the width rolling reduction.

The reduction force at the light thickness-reduction rolls 27 is 100 to 200 tf per cast strip width. In general, the driving power for the light thickness-reduction rolls 27 is low when the rolling reduction is of the order of 1 to 3 mm. Accordingly, in order to apply the tension to the cast strip 7 as described above, it is preferable to give the negative power to the motor 31 for the light thickness-reduction rolls 27. This applies the negative power, that is, the braking force is applied to the cast strip 7 until slippage occurs between the cast strip 7 and the surfaces of the respective light thickness-reduction rolls 27. Since the friction coefficient between the cast strip 7 and the light thickness-reduction rolls 27 is in the order of $\mu=0.5$, it is possible a apply the tension of 50 to 100 tf to the cast strip 7 until the latter slips. Accordingly, supposing that the strip thickness is 30 mm, the tension capable of being applied to the cast strip 7 is brought to a level of 1.67 to 3.3 kg/mm$^2$ per unit area.

In the illustrated embodiment, only the driving force for the light thickness-reduction rolls 27 is brought to the value lower than the requisite value However, if the power for the motor 33 driving the correcting rolls 29 is regulated in a manner similar to the light thickness-reduction rolls 27, and the deficiency is compensated for by the power supplied to thickness-reduction rolls 35, through the cast strip it is possible to apply higher tension to the cast strip 7. Although the details of the calculation results are omitted, it is possible in this case to apply tension in the order of 2 to 4 kg/mm$^2$ per unit area, to the cast strip 7.

Further, in the illustrated embodiment, no power is applied to the width-reduction rolls 34, and the corresponding work amount is also supplied to these rolls through the cast strip by the thickness-reduction rolls 35. Thus, the tension in the cast strip 7 is correspondingly increased, making it possible to further increase the width rolling reduction.

The results of experiments show that when no tension was applied to the cast strip, it was possible to regulate the strip width only by an amount in the order of 10 to 20 mm, while when a tension was applied to the cast strip, it was possible to regulate the width to an extent of 50 to 80 mm.

On the other hand, if such light thickness-reduction rolling, width-reduction rolling and thickness-reduction rolling are performed, variation in speed of the cast strip 7 occurs within the curved section at the loop regulating looper 11, so that the loop amount of the cast strip 7 within the curved section varies This variation in the loop amount is detected by the differential transformer 24 of the loop regulating looper 11, and the detected value is sent to the controller 25. On the basis of the magnitude of the detected value, the controller 25 controls the motor 36 driving the thickness-reduction rolls 35. Thus, the rolling speed is regulated such that the loop amount is brought to a constant value.

In this case, no particular variation for control is required to be given to the regulation of the loop amount, because the power for the motor 31 driving the light thickness-reduction rolls 27 and, further, the power for the driving motor 33 if the power of the correcting rolls 29 are also controlled, are set to the respective values lower than the respective requisite values.

Moreover, since the width-reduction rolling is effected while applying the tension to the cast strip, the width of the cast strip varies slightly at the thickness-reduction rolls 35 correspondingly. This variation in the strip width is detected by the strip width detector 37. On the basis of the detected variation, the controller 38 controls driving of the motors 39*a* and 39*b*. Accordingly, the worm speed-reducing units 40*a* and 40*b* are driven to extend or retract the respective screws 41*a* and 41*b*, thereby moving the respective bearing boxes 42*a* and 42*b* for the respective width-reduction rolls 34. This controls the width rolling reduction due to the width-reduction rolls 34, so that the strip width variation due to the tension in the cast strip at the thickness-reduction rolls 34 is compensated.

The cast strip 7 is brought to a cross-sectional shape shown in FIG. 3, by the width-reduction rolling due to the vertical rolls 34. However, this is corrected for by the rolling due to the thickness-reduction rolls 35.

The cast strip 7 having been subjected to the above-described processing is bent upwardly by the group of rollers 52, 53 and 56 of the upward bending unit. Subsequently, the cast strip 7 is again bent downwardly by the group of rollers 58, 59 and 60 of the downward bending unit, and then is taken up into the coil 70 on the coil support rollers 60.

As the cast strip wound into the coil 70 reaches a predetermined length, the cast strip is cut by the rotary cutters 51, so that a single coil 70 is completed.

The coil is delivered onto the coil intermediate stand-by position rollers 61, and is supported by the same as a coil 71. Subsequently, the coil is mounted on the unwinding rollers 62 as a coil 72, and these rollers 62 are rotatively driven. At this time, finding of an end of the coil 72 is effected by the end-finding knife roller 63, and the cast strip 73 is delivered to the thickness-reduction rolling mill 64. The rolling mill 64 rolls the cast strip 73 to reduce its thickness, thereby manufacturing the product 74. The product 74 is delivered through the guide roller 65 and is taken up about the drum 66 into a coil 75.

Of course during the period for which the product 74 is taken up about the drum 66, the casting, rolling and taking-up operations are continued at the continuous casting machine 1 and the rolling installation 10, so that a subsequent coil is formed on the coil support rolls 60.

Although it has been described that the rolling reduction at the light thickness-reduction rolls 27 is in the order of 1 to 3 mm, it is undesirable to further increase the rolling reduction at the rolls 27. The reason for this is that if the thickness of the cast strip becomes thin, buckling tends to occur in the widthwise direction at the width-reduction rolling, and the cast strip tends to be cooled.

Moreover, it has been described that the light thickness-reduction rolls 27 are arranged within the stand 26 and upstream of the correcting rolls 29 which are also arranged within the stand 26. However, the light thickness-reduction rolls 27 and the correcting rolls 29 may be changed in their positional relationship. Furthermore, the correcting rolls 29 may be replaced by light thickness-reduction rolls such that both the light thickness-reduction rolls have double functions of light-reduction rolling and correcting.

Further, only pinch rollers for correcting bending of the cast strip may be arranged within the stand 26. In this case, the light thickness-reduction rolling mill is arranged between the stand 26 and the width-reduction rolling mill 13. It is possible also for such arrangement to obtain advantages similar to those described previously.

Figure 4:
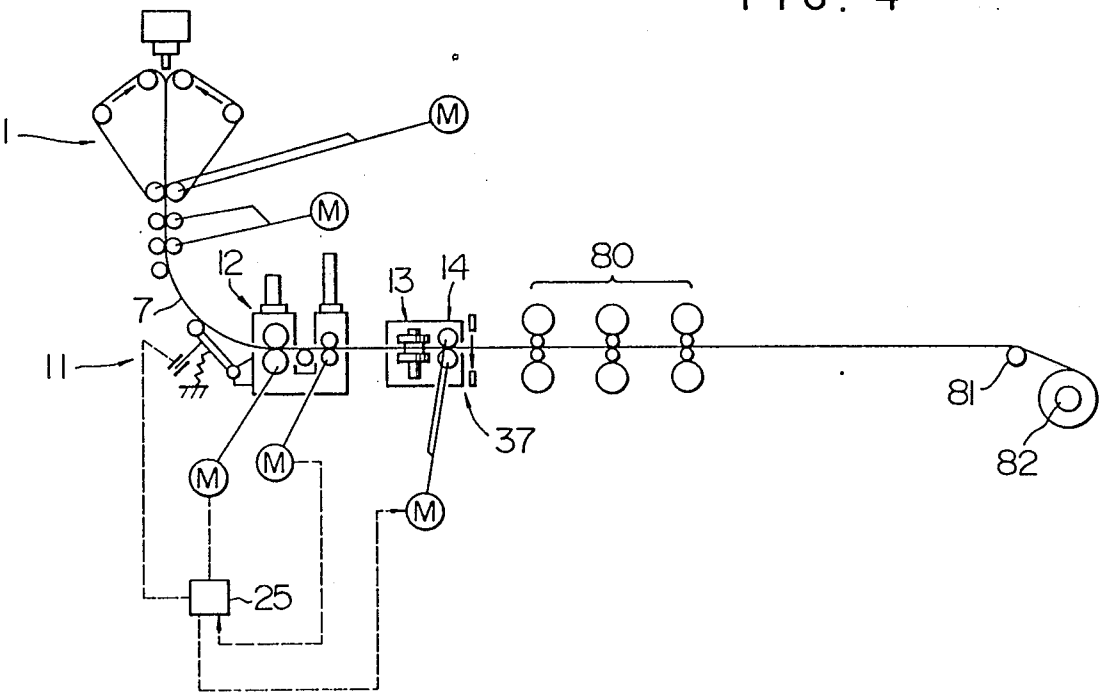
FIG. 4 is a schematic view similar to FIG. 1, but showing a rolling installation according to another embodiment of the invention and a continuous casting machine.

In the embodiment described above, the cast strip 7 having passed through the width-reduction rolling mill 13 and the thickness-reduction rolling mill 14 is once taken up, and is rolled to the predetermined thickness by the thickness-reduction rolling installation 43 which is provided as the subsequent step. However, the cast strip can also directly be rolled without being once taken up. FIG. 4 shows another embodiment of the invention in which the cast strip is directly rolled without being once taken up. Components 80, 81 and 82 corresponding respectively to the thickness-reduction rolling mill 64, the guide roller 65 and the take-up drum 66 of the thickness-reduction rolling installation 43 in the first embodiment are arranged directly on the exit side of the thickness-reduction rolling mill 14. The invention is applicable also to the arrangement illustrated in FIG. 4.

It will be clear from the foregoing, the arrangement of the rolling method and the rolling installation for the continuous cast strip according to the invention is such that the cast strip is so rolled as to be reduced in width while having applied thereto the longitudinal tension. With such an arrangement, it is easy for that compression strain to occur in the cast strip in the widthwise direction thereof at the width-reduction rolling. Thus, the width-reduction rolling load per unit width rolling reduction is decreased so that it is difficult for buckling occur in the strip widthwise direction. As a result, it is possible to remarkably increase the width rolling reduction.

What is claimed is:

1. A method of rolling a continuous cast strip to reduce its width, comprising the steps of:

forming the continuous cast strip by a continuous casting machine;

before cutting the cast strip, delivering the cast strip to a width-reduction rolling mill through a looper arranged between the continuous casting machine and the width-reduction rolling mill, including forming a loop amount of the cast strip with said looper; and rolling the cast strip to reduce its width while applying a longitudinal tension to the cast strip as it passes through the width-reduction rolling mill by applying a braking force to hold the cast strip on the upstream side of the width-reduction rolling mill and by exerting a driving force on the cast strip on the downstream side of the width-reduction rolling mill.

2. The method of rolling a continuous cast strip according to claim 1, wherein said forming of the continuous cast strip forms a cast strip in the range of 20 to 40 mm in thickness.

3. A casting/rolling apparatus for casting and rolling a continuous cast strip to reduce its width without cutting the cast strip, comprising:

a continuous casting machine for forming the continuous cast strip;

a width-reduction rolling mill arranged downstream of said continuous casting machine receiving the continuous cast strip from said continuous casting machine;

a looper arranged between the continuous casting machine and said width-reduction rolling mill; and tension applying means for applying a longitudinal tension to the cast strip as it passes through said width-reduction rolling mill, said tension applying means including pressing roll pairs arranged respectively on an upstream side and a downstream side of said width-reduction rolling mill, means for driving said pressing roll pairs, and means for controlling said driving means sot hat said downstream pressing roll pair applies a driving force on said cast strip to move it through said width-reduction rolling mill and said upstream pressing roll pair exerts a braking force for slowing the movement of said cast strip whereby a difference int he braking and holding forces causes the longitudinal tension in said cast strip.

4. The casting/rolling apparatus according to claim 3, wherein said casting machine includes means for forming a cast strip in the range of 20 to 40 mm in thickness.

5. A method of rolling a continuous cast strip to reduce its width, comprising the steps of:

forming the continuous cast strip by a continuous casting machine;

delivering the cast strip to a width-reduction rolling mill without cutting the cast strip through a looper;

detecting a loop amount of the cast strip formed by the looper;

rolling the cast strip to reduce its width while applying a longitudinal tension to the cast strip as it passes through the width-reduction rolling mill by applying a braking force with a pair of upstream rolls to hold the cast strip on the upstream side of the width-reduction rolling mill and by exerting a driving force with a pair of downstream rolls on the cast strip on the downstream side of the widthreduction rolling mill, and further controlling the speed of the downstream pair of rolls in accordance with the detected loop amount to maintain the loop amount at a predetermined value.

6. The method of rolling a continuous cast strip according got claim 5, further comprising the steps of:

detecting a variation in the cast strip width downstream of the width-reduction rolling mill and controlling said rolling of the cast strip to reduce its width sot hat the cast strip width variation caused by varying the tension in the cast strip resulting from said controlling of the speed of the downstream pair of rolls is compensated.

7. The method of rolling a continuous cast strip according to claim 6, further comprising the step of thickness-reduction rolling of the cast strip downstream from said width-reduction rolling mill for rolling the cast strip to a uniform thickness across its width.

8. The method of rolling a continuous cast strip according to claim 5, wherein said forming of the continuous cast strip forms a cast strip in the range of 20 to 40 mm in thickness.

9. A casting/rolling apparatus for casting and rolling a continuous cast strip to reduce its width without cutting the cast strip, comprising:

a continuous casting machine for forming the continuous cast strip;

a width-reduction rolling mill arranged downstream of said continuous casting machine receiving the continuous cast strip from said continuous casting machine;

a looper for forming a loop amount of the cast strip arranged between the continuous casting machine and the width-reduction rolling mill having means for detecting a loop amount and outputting a detected value;

tension applying means for applying a longitudinal tension to the cast strip as it passes through said width-reduction rolling mill, said tension applying means including pressing roll pairs arranged respectively on an upstream side and a downstream side of said width-reduction rolling mill, means for driving said pressing roll pairs, and means receiving said detected value for controlling said driving means so that said downstream pressing roll pair applies a driving force on said cast strip to move it through said width-reduction rolling mill to maintain the loop amount at a predetermined amount and said upstream pressing roll pair exerts a braking force for slowing the movement of said cast strip whereby a difference int he braking and holding forces causes the longitudinal tension in said cast strip.

10. The casting/rolling apparatus according to claim 9, further comprising:

means for detecting a variation in the cast strip width downstream of the width-reduction rolling mill and means for controlling said rolling of the cast strip to reduce its width so that the cast strip width variation caused by varying the tension in the cast strip resulting from controlling said driving means to maintain the loop amount at a predetermined value is compensated.

11. The casting/rolling apparatus according to claim 10, further comprising a thickness-reduction rolling mill arranged downstream from said width-reduction rolling mill for rolling the cast strip to a uniform thickness across its width.

12. The casting/rolling apparatus according to claim 9, wherein said casting machine includes means for forming a cast strip in the range of 20 to 40 mm in thickness.

* * * * *